US007088841B2

(12) United States Patent
Kallen

(10) Patent No.: US 7,088,841 B2
(45) Date of Patent: Aug. 8, 2006

(54) SUBWOOFER

(75) Inventor: Drew Kallen, Chandler, AZ (US)

(73) Assignee: Diamond Audio Technology, Inc., Chandler, AZ (US)

( * ) Notice: Subject to any disclaimer, the term of this patent is extended or adjusted under 35 U.S.C. 154(b) by 516 days.

(21) Appl. No.: 10/642,102

(22) Filed: Aug. 15, 2003

(65) Prior Publication Data

US 2004/0086144 A1 May 6, 2004

Related U.S. Application Data

(60) Provisional application No. 60/403,724, filed on Aug. 15, 2002.

(51) Int. Cl.
*H04R 25/00* (2006.01)

(52) U.S. Cl. ..... 381/397; 381/396

(58) Field of Classification Search ..... 381/164–166, 381/395–398, 433; 310/16
See application file for complete search history.

(56) References Cited

U.S. PATENT DOCUMENTS 4,564,727 A 1/1986 Danley et al.
4,933,975 A 6/1990 Button
5,173,943 A 12/1992 Dzurko
5,721,401 A 2/1998 Sim
5,748,753 A 5/1998 Carver
5,802,189 A 9/1998 Blodget
5,802,191 A 9/1998 Guenther
5,828,766 A 10/1998 Gallo
5,937,074 A 8/1999 Carver
6,111,969 A 8/2000 Babb
6,181,796 B1 1/2001 Johnson
6,404,897 B1 6/2002 Devantier et al.
6,418,231 B1 7/2002 Carver

*Primary Examiner*—Suhan Ni
(74) *Attorney, Agent, or Firm*—Jeffrey D. Peterson; Michael Best & Friedrich LLP

(57) ABSTRACT

A subwoofer having a novel component geometry that permits large voice coils and high efficiency heat transfer capability. The subwoofer comprises a frame having an outside and an inside, a central portion, radial heat sink fins, lower ventilation apertures, and a bottom portion having a bottom vent aperture. A motor unit comprising a case and a pole unit, the case having lower ventilation apertures and the pole unit having a cylindrical portion having a center aperture, wherein the cylindrical portion of the pole unit is of a diameter less than the diameter of the case, defining a first chamber area. The lower ventilation apertures of the frame, and the lower ventilation apertures of the motor unit are aligned to allow air to flow from the outside of the subwoofer into the first chamber area.

32 Claims, 6 Drawing Sheets

SUBWOOFER

CROSS-REFERENCE TO RELATED APPLICATIONS

This application claims the benefit of the priority date of U.S. Provisional Application No. 60/403,724 filed Aug. 15, 2002 which is incorporated herein by reference.

STATEMENT REGARDING FEDERALLY SPONSORED RESEARCH OR DEVELOPMENT

Not Applicable

BACKGROUND OF THE INVENTION

This invention relates to subwoofer audio speakers that produce low-frequency sound, generally operating below 100 Hz. The operating principle of a moving coil loudspeakers is based on coil of wire or (voice coil) immersed in a static magnetic field. This voice coil is fed electrical input signals and the resulting electromotive force induced in the coil forces the loudspeaker diaphragm to move.

"Subwoofer" is the term generally used today to refer to audio speakers that operate in the low frequency or bass range. Until more recent times, there was very little need to reproduce intense levels of sound down to 20 Hz (the low range for human hearing) because available programming sources were incapable of recording such frequencies. With the advent of more dynamic recording techniques, however, the ability of a subwoofer to reproduce low frequency input signals without distortion, i.e., as accurately as possible, has become a highly desirable objective in the industry.

Audio speakers, generally, are quite simply air pistons that move back (on the negative cycle of an electrical signal) and forth (on the positive cycle) creating different degrees of air pressure. These movements translate into different frequencies that, in turn, translate into Mozart or Manilow or Metallica at the human eardrum.

The typical subwoofer design has been around for over 50 years. Like any speaker, a subwoofer requires an audio amplifier which produces electrical impulses that alternate from positive to negative voltages and create an electromagnet when they reach a "voice coil" (a spool of wire) inside the speaker. The voice coil is suspended between the pole pieces of a permanent magnet motor structure. This voice coil is attached to the cone/moving mass assembly which is mounted to a frame that is fixed to the motor structure. The voice coil reciprocates (i.e., moves the cone back and forth) in a linear path as the alternating current flows through the voice coil that is centered in the magnetic gap (between the two poles). The circumference of the cone is affixed to a "surround" or "suspension", which is affixed to a frame or basket, and which is generally constructed of a metal. The magnet is typically mounted to the rear of the frame behind the cone. The surround is generally a circular half-roll of flexible material that joins the top of the cone and the speaker's frame. A spider, which is a circle of flexible corrugated material, joins the bottom of cone to the speaker's frame. The surround and spider center the cone/moving mass assembly and restore it to its original position. The peak-to-peak distance traveled by the cone is known as the "excursion". Generally, the peak-to-peak excursion of a conventional subwoofer is between 0.4–0.6 inches.

The voice coil movement causes the movement of the cone. Movement of the cone about the surround causes air to be moved, which is what produces the sound heard and, in the case of bass, felt by the listener.

The circular diaphragms or cones have been constructed of many different materials including paper, plastic and Kevlar™. Suspensions or surrounds are generally constructed of flexible, nonself-supporting, compliant materials such as relatively thin rubber, impregnated cloth, expanded synthetic cellular foam such as, e.g., expanded cellular polyethylene ("PE") surround foam, or similar materials, which are compressible and produce very little resistance to peak-to-peak cone movement. The magnets are generally large ceramic magnets with a top plate, back plate and pole piece.

In a conventional speaker geometry, the large insulating ceramic magnets are located on the outside of the voice coil which does not allow for good thermal transfer away for from the coil. Because of the large size of a high power/high strength conventional voice coil motor, it often precludes being able to encapsulate the motor assembly. Conventional voice coil motors are typically mounted to the back of the frame due to similar reasons.

To achieve accurate low frequency reproduction, conventional subwoofers have been provided with long voice coils, large diameter voice coils, large magnets, large cones and large enclosures. There are, however, several limits in these design alternatives. There is, e.g., a practical limit on magnet size, design and weight. Activation of longer and larger voice coil results in large power losses in the form of heat. Possible thermal destruction of the coil imposes a limit on the power handling capacity of the speaker. Further, using large cones is problematic because it is difficult to design sufficiently rigid cones with large surface areas to resist distortion.

To reproduce high volume levels of low frequencies, a subwoofer must be capable of moving large quantities of air. It is possible to increase the excursion of the cone, and thus, increase the amount of air that is moved. However, when the excursion is increased, the efficiency of the speaker is substantially reduced, as less of the voice coil will remain in the magnetic gap. Another way to increase air movement is to use more than one subwoofer. This leads to large enclosures to house the devices.

Yet, today's market demands that a subwoofer be optimized for use in a relatively small enclosure, handle extremely high power levels, and displace a large volume of air all without a hint distortion.

Small enclosure compatibility requires a high moving mass, stiff suspension, low resonance, and high magnetic force. High thermal power handling requires large diameter voice coils and a means for dissipating the heat that is generated. To displace a large amount of air, the excursion must be as great a distance as possible. In other words, low distortion requires that the excursion be maximized and linear, the heat be minimized, and the electromechanical parameters be suited for small enclosures.

While many techniques have been used for removing heat from voice coils, and many additional techniques have been proposed, most of these techniques involve either active cooling through use of a fan or additional space-consuming hardware, such as a heat sink. A need therefore exists for a simple and relatively inexpensive technique for removing heat from the voice coil of a speaker, particularly a high performance speaker, which technique does not require either the use of an active cooling component or the use of an extra piece of heat dissipation hardware, but instead requires only the use of components normally existing in such a speaker.

SUMMARY OF THE INVENTION

The present invention provides a subwoofer characterized, among other things, by its novel thermal dissipation features.

The subwoofer in accordance with the present invention includes a frame having an outside and an inside, a central portion, a basket ring, a plurality of basket arms, radial heat sink fins, upper ventilation apertures, lower ventilation apertures, and a bottom portion having a bottom vent aperture.

The subwoofer further includes a motor unit having a case and a pole unit. In one embodiment the case comprises a top section, a side section having lower ventilation apertures and a bottom lip section. The pole unit, in one embodiment, comprises a base plate, a cylindrical portion having a center aperture, a field plate and a magnet. The magnet has a center aperture. The magnet can be a segmented magnet allowing for ventilation channels to be formed allowing air to flow between the magnet segments. The pole unit can also include a shorting ring which can contain ventilation grooves. The field plate is suitably of a diameter greater than that of the magnet and shorting ring.

The cylindrical portion of the pole unit is of a diameter less than the diameter of the case. The space between the case and the pole unit defines a first chamber area. The lower ventilation apertures of the frame, and the lower ventilation apertures of the motor unit are aligned to allow air to flow from the outside of the subwoofer into the first chamber area inside the subwoofer.

The subwoofer is also comprised of a voice coil former, the former is cylindrically shaped and has an upper and lower portion, and having vent apertures therethough. A voice coil is positioned on the lower portion of the voice coil former.

The subwoofer also is comprised of a cone having a first and second edge, the first edge being connected to a surround, which is connected to the basket ring of the frame and the second edge being connected to the upper section of the voice coil former. A dust cap is connected to the cone.

The subwoofer also includes a spider having a first and second edge. The first edge being connected to the central portion of the frame, and the second edge being connected to the upper portion of the voice coil former. Suitably, two spiders are utilized in the subwoofer of the present invention.

The spider (or spiders), frame and voice coil former define a second chamber area. The upper ventilation apertures of the frame allow air from outside the subwoofer into the second chamber area.

Other features of the invention will become apparent to those skilled in the art upon review of the following detailed description, claims and drawings.

BRIEF DESCRIPTION OF THE DRAWINGS

The preferred exemplary embodiment of the present invention will hereinafter be described in conjunction with the appended drawing wherein like designations refer to like elements throughout and in which the drawings are not necessarily to scale, emphasis instead being placed on illustrating the principles of the present invention, and wherein.

Figure 1:
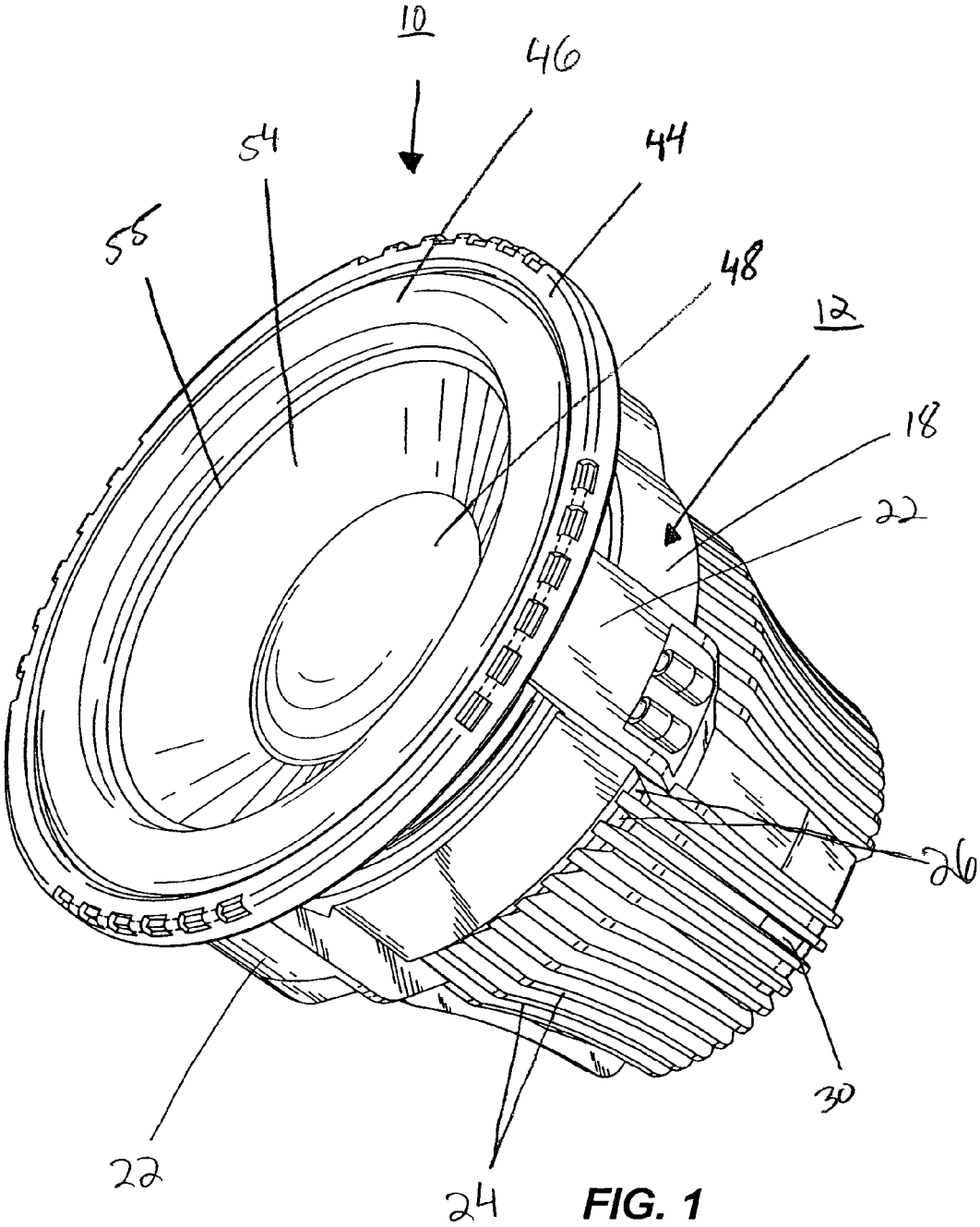
FIG. 1 is a top perspective view of the subwoofer of the present invention.
Figure 2:
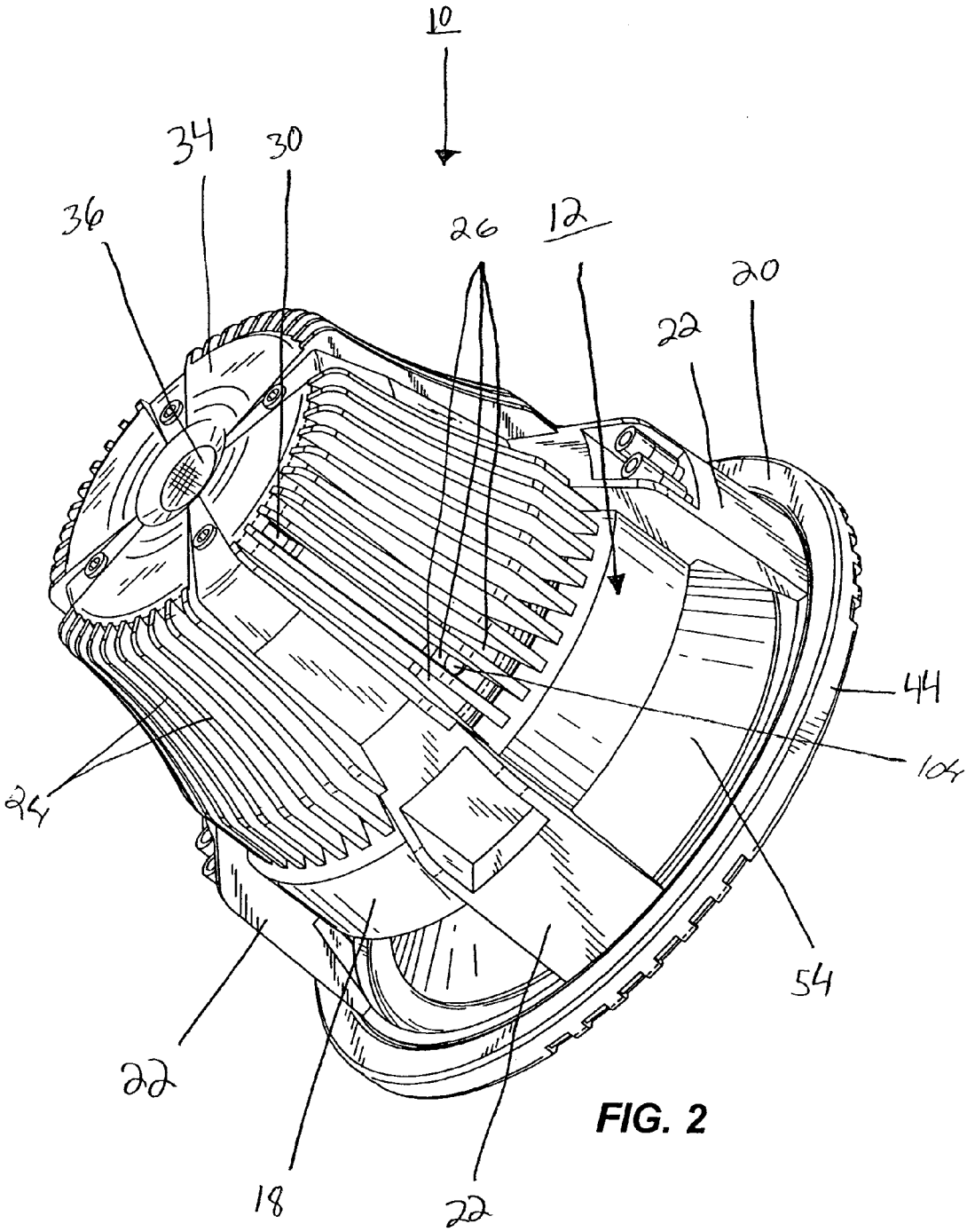
FIG. 2 is a bottom perspective view of the subwoofer of the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including", "having" and "comprising" and variations thereof herein is meant to encompass the items listed thereafter and equivalents thereof as well as additional items and equivalents thereof.

DETAILED DESCRIPTION OF THE INVENTION

The present invention features a subwoofer having a novel component geometry that permits large voice coils and high efficiency heat transfer capability. It should be understood that the principles of the present invention can be applied to other speaker designs, and the subwoofer shown and described in FIGS. 1–8 is merely an example of such designs.

One embodiment of the subwoofer 10 of the present invention is depicted in FIGS. 1–8. The present invention provides a subwoofer 10 comprising a frame 12, a voice coil former 96, a voice coil 102, a motor unit 68, a first spider 56, a second spider 62, a cone 54, a dust cap 48, and a surround 46.

FIGS. 1, 2, 6 and 7 best depict the frame 12 of the present invention. The frame 12 has an outside 14, an inside 16, a central portion 18, a basket ring 20, a plurality of basket arms 22, radial heat sink fins 24, upper ventilation apertures 26, lower ventilation apertures 30, and a bottom portion 34 having a bottom vent aperture 36. The frame of the subwoofer can suitably by made from a one-piece die-cast metal, suitably aluminum. The one piece arrangement provides integral radial heat sink fins. The upper ventilation apertures 26 and the lower ventilation apertures 30 are positioned between the radial heat sink fins 24.

Figure 4:
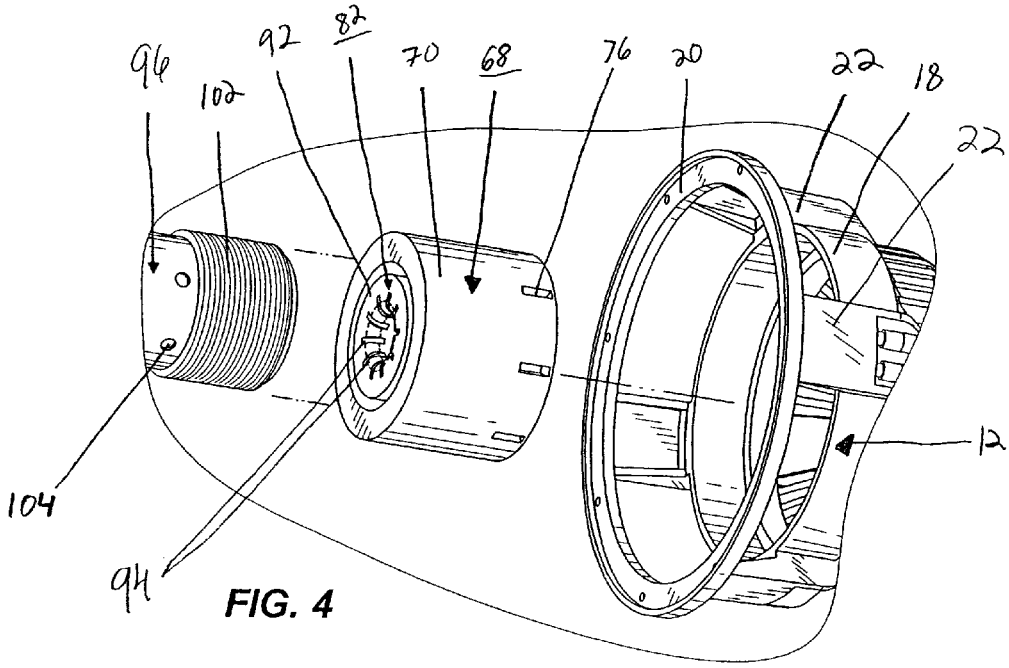
FIG. 4 is a partial exploded view of the voice coil former, motor unit and frame of the subwoofer of the present invention.
Figure 8:
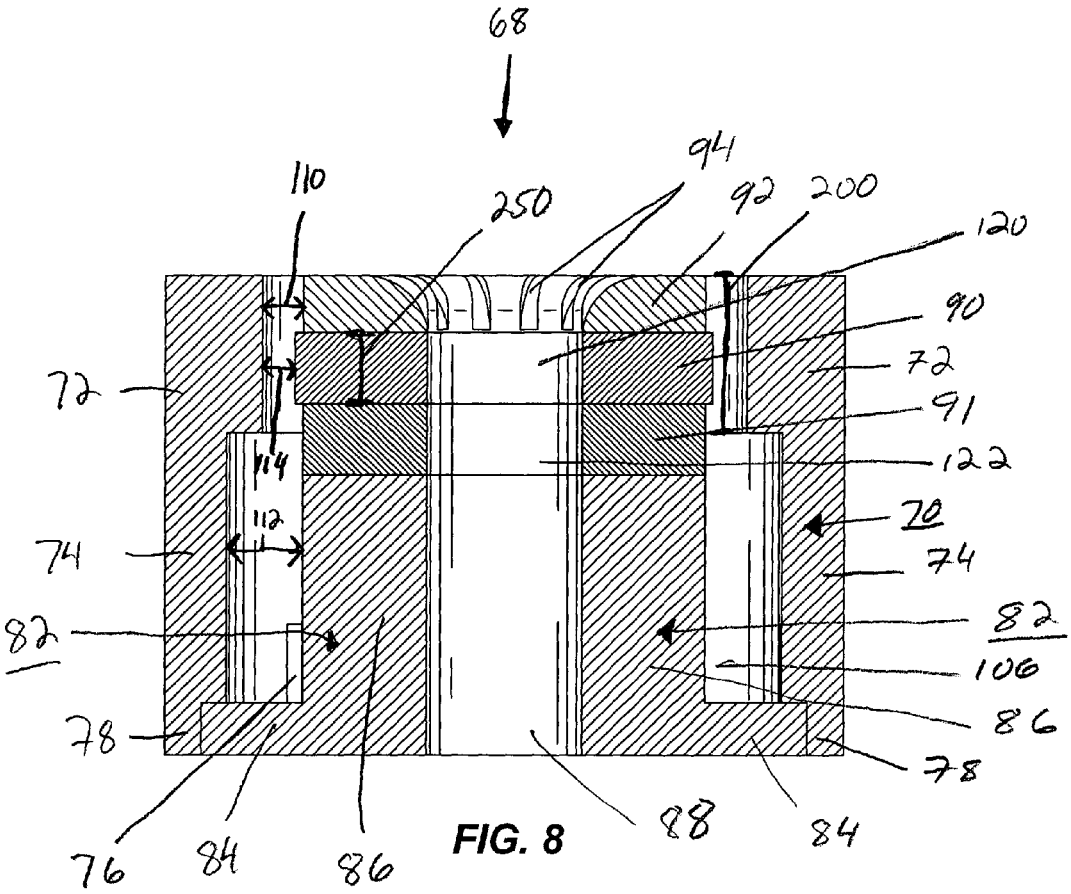
FIG. 8 is a side cutaway view of the motor unit of the present invention.

One embodiment of the motor unit 68 of the present invention is best shown in FIGS. 4 and 8. The motor unit 68 is comprised of a case 70 and a pole unit 82. In the embodiment shown in FIG. 8, the case comprises a top section 72, a side section 74 having lower ventilation apertures 76 and a bottom lip section 78. The pole unit 82, comprises a base plate 84, a cylindrical portion 86 having a center aperture 88, a field plate 90 having a center aperture 120, a magnet 91 having a center aperture 122 and a shorting ring 92 having ventilation grooves 94. The field plate 90 suitably has a diameter greater than the magnet 91 and the shorting ring 92. The cylindrical portion of the pole unit 86 is of a diameter less than the diameter of the side portion 74 of the case 70. The space between the side portion 74 of the case 70 and the cylindrical portion 86 of the pole unit 82 defines a first chamber area 106.

Figure 9:
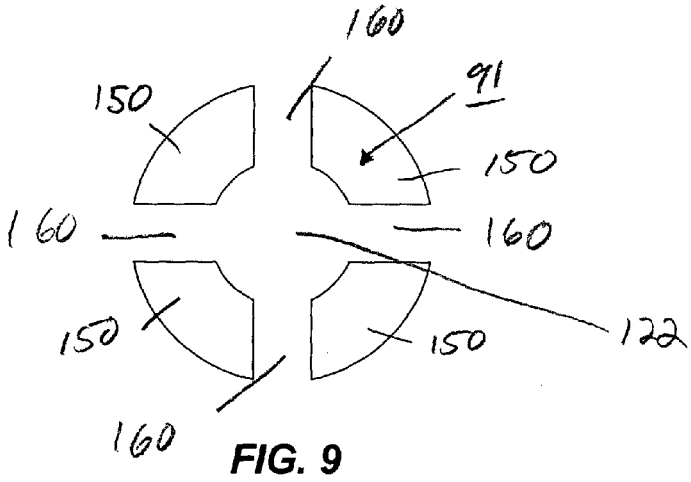
FIG. 9 shows a top view of the segmented magnet of the present invention.

The case 70 and the pole unit base 84, cylindrical portion 86 and filed plate 90 can consist of ferrous low carbon steel to carry as much magnetic flux as possible. Steel is also an excellent conductor of heat to provide an ideal thermal dissipation path. The magnet 91 can consist of any suitable magnetic material such as a rare earth magnet like neodymium boron. The magnet 91 is suitably segmented (as shown in FIG. 9), the segments 150 being spaced to provide ventilation channels 160 in the magnet 91, allowing air to flow through the magnet 91 and into the center of the pole unit 82. The magnet 91 can be segmented into as many pieces, and the ventilation channels 160 can be of any size, as selected by one of skill in the art to allow the desired amount of air flow. The shorting ring 92 is suitably made from aluminum or copper. The shorting ring 92 acts in one respect as a heat sink to wick heat away from the voice coil and other neighboring components. The shorting ring 92 takes advantage of the air flow exchanged from the cavity underneath the dust cap through the other cooling paths during high excursion/high power use. The shorting ring 92 also effectively short circuits the opposing "eddy" currents that would normally flow through the voice coil wire 102 during use. This is in part due to the non-ferrous, electrically conductive properties of the shorting ring 92 which is in very close proximity to the magnetic air gap. Without the shorting ring 92, the inductance of the coil 102 can go up significantly and inductive heating will likely occur at very high power, hence power compression effects and higher distortion.

Figure 3:
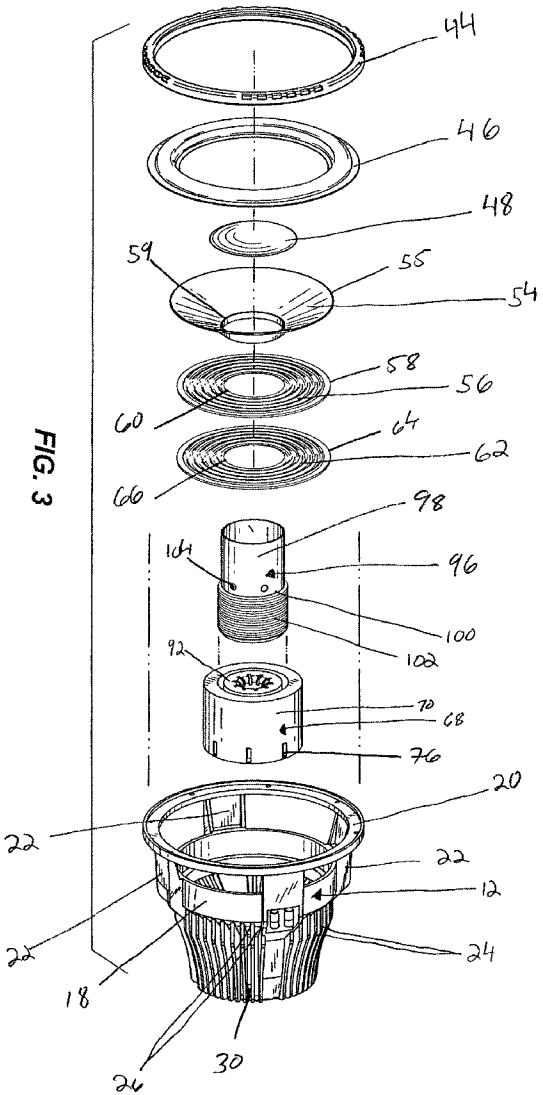
FIG. 3 is an exploded view of the subwoofer of the present invention.
Figure 5:
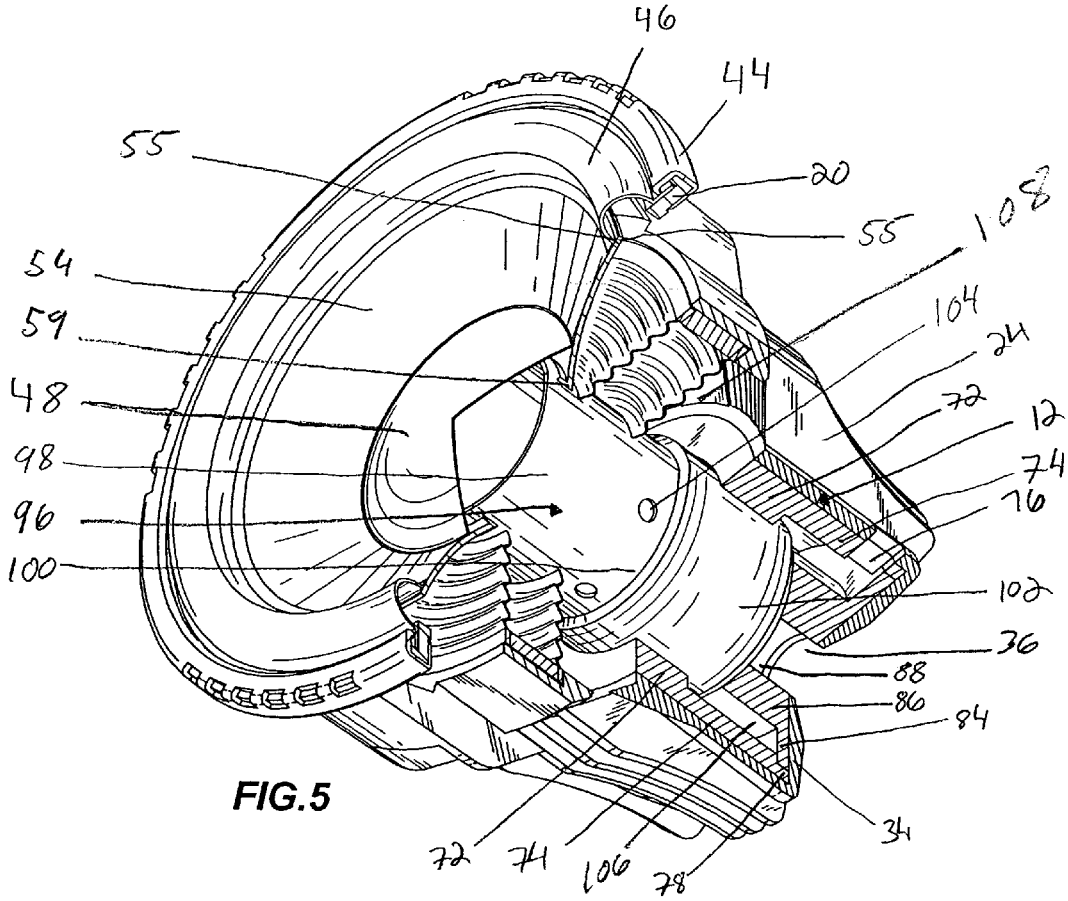
FIG. 5 is a cutaway top perspective view of the subwoofer of the present invention.
Figure 6:
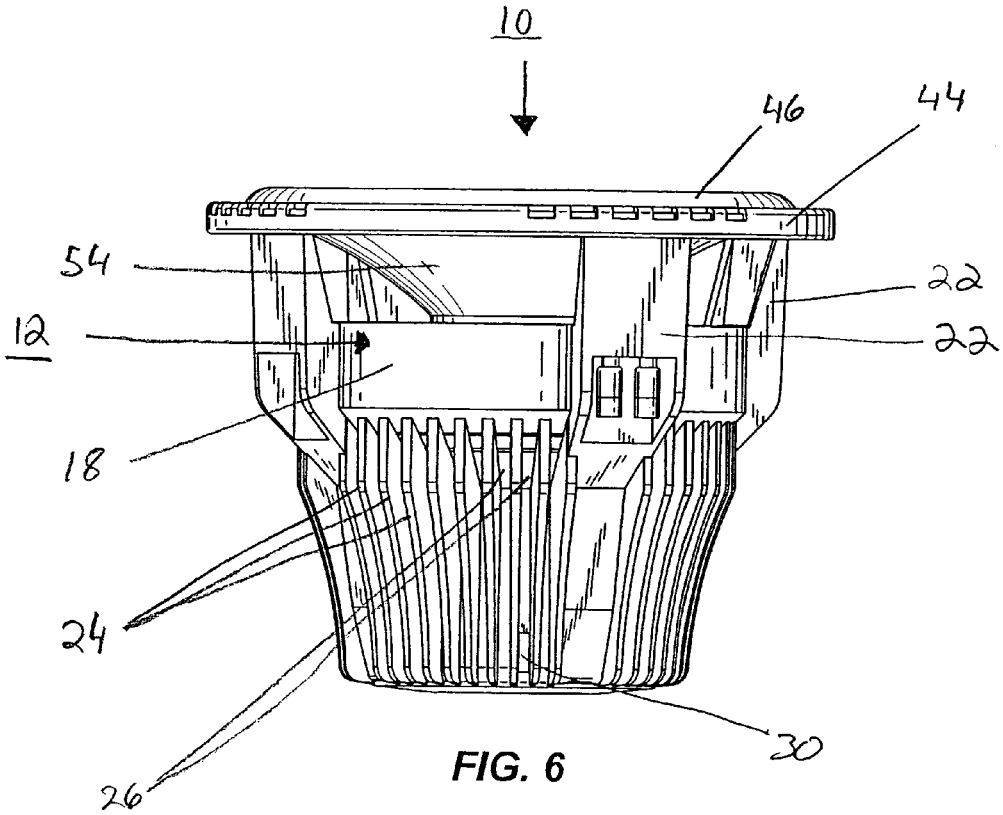
FIG. 6 is a side view of the subwoofer of the present invention.
Figure 7:
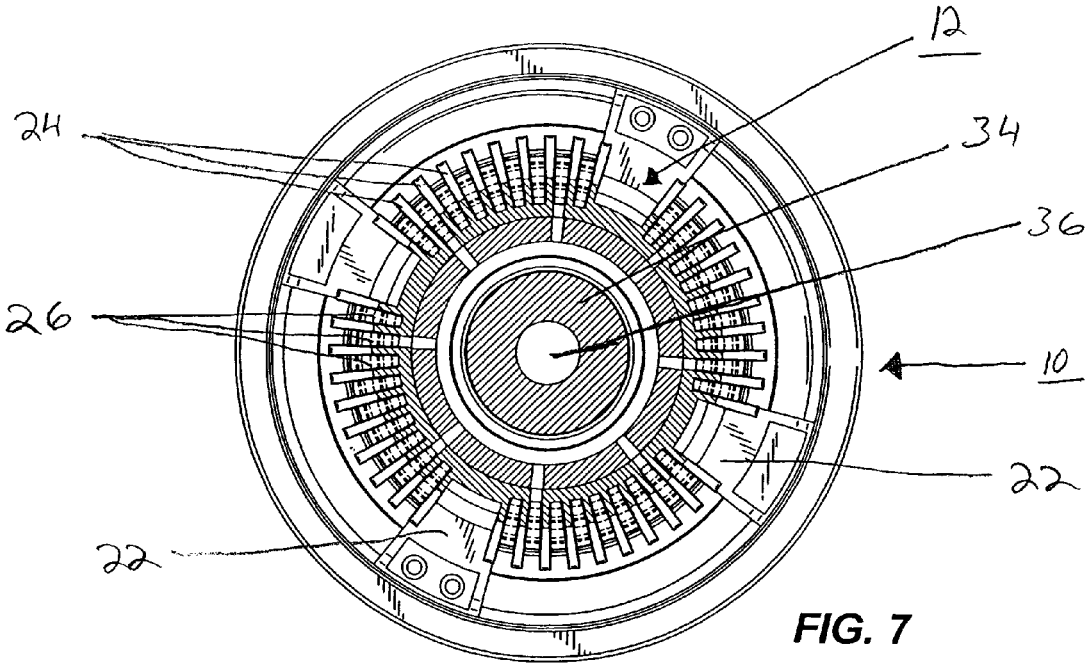
FIG. 7 is a bottom view of the subwoofer of the present invention.

The voice coil former 96 of the subwoofer 10 is best shown in FIGS. 3–5. The voice coil former 96 is cylindrically shaped having an upper portion 98, and a lower portion 100. The voice coil former 96 also has vent apertures 104 positioned on the walls of the former 96. A voice coil 102 is positioned on the lower portion 100 of the voice coil former 96. The voice coil 102 may be comprised of coils made of copper, aluminum, or copper-clad aluminum, which generally have a diameter of 2" up to 6".

The spiders 56 and 62 of the subwoofer are best shown in FIGS. 3 and 5. The subwoofer 10 of the shown embodiment has a first spider 56 and a second spider 62. The first spider 56 has a first edge 58 and a second edge 60, the first edge 58 being connected to the central portion 18 of the frame 12, and the second edge 60 being connected the upper portion 98 of the voice coil former 96. The second spider 62 has a first edge 64 and a second edge 66, the first edge 64 being connected to the central portion 18 of the frame 12, and the second edge 66 being connected the upper portion 98 of the voice coil former 96. The second spider 62, frame 12 and voice coil former 96 define a second chamber area 108. The spiders 56 and 62 are suitably dual mirrored, and made of a poly-aramid fiber, with lead wires woven in and/or periodically stitched in place. This allows for symmetrical movement of the voice coil. Such spiders are tear resistant and have virtually no lead wire noise and fatigue.

The cone 54 of the subwoofer is best depicted in FIGS. 3 and 5. The cone 54 of the subwoofer 10 has a first edge 55 and a second edge 59, with the first edge 55 being connected to the surround 46, which is, in turn, connected to the basket ring 20 of the frame 12. The second edge 59 of the cone 54 is connected to the upper portion 98 of the voice coil former 96. The cone 54 suitably has a three-layer sandwich construction, e.g., Kevlar™/Nomex™ honeycomb/Kevlar™. Such a construction provides great stiffness and low mass. This "sandwich" layer cone can also be comprised from similar materials. The surround 46 is suitably constructed of a rubber, e.g., nitrile butadiene, that exhibits excellent elongation behavior which provides controlled excursion and restoring force. The dimensional and elongation characteristics are matched to the magnetic linearity of the voice coil and motor structure as well as the geometry of the spiders.

The components of the subwoofer 10 are fixed within the frame 12 as follows. The arrangement of the components is best shown in FIGS. 3–5.

The motor unit 68 is mounted on the inside surface 16 of the frame 12 on the bottom 34 of the frame 12. The motor unit 68 geometry is configured to have the metal motor case 70 in direct surface contact to the frame 12. The frame 12 encapsulates the motor unit 68 and serves as a heat sink to wick the heat away from the motor unit 68 and voice coil 102. Thermally conductive lubricant is used between the outer surface of the motor unit 68 and frame 12. The lubricant helps to ensure thermal transfer away from the motor unit. The lower ventilation apertures 30 of the frame 12, and the lower ventilation apertures 76 of the motor unit 82 are aligned to allow air to flow from the outside 14 of the subwoofer 10 into the first chamber area 106 inside 16 the subwoofer 10. The bottom vent aperture 36 of the frame 12 is also aligned with the center aperture 88 of the pole unit 82.

The voice coil former 96 structure is disposed within the motor unit 68 between the case 70 and the pole unit 82. Because the high energy magnet 90 is mounted on the inside of the voice coil 102, the available voice coil size can be much greater than that of motors that use ceramic magnets, and excursions can be higher. The shorting ring 92 is mounted on the top of the first magnet 90 of the pole unit 82, and inside the voice coil 102.

The first 56 and second 62 spiders are connected at one end (58 and 64 respectively) to the central portion 18 of the frame 12, and at the other end (60 and 66 respectively) to the upper portion 98 of the voice coil former 96. The cone 54 is also connected to the upper portion 98 of the voice coil former along the second edge 59. The first edge 55 of the cone 54 is connected to the surround 46, which is in turn connected to the basket ring 20 of the frame 12. A dust cap 48 is connected to the cone 54, and covers the central aperture of the cone. A frame surround 44, suitably made of a durable plastic or rubber, covers a portion of the surround 46 and the basket ring 20 of the frame 12.

The subwoofer 10 of the present invention is designed to advantageous heat transfer capabilities. The radial heat sink fins 24 of the frame 12 are positioned so that this air flow blows across these radial fins 24 for additional and more rapid cooling. The use of the radial finned heat sink fins 24 and the ventilation grooved 94 shorting ring 92 also substantially reduces the distortion of the subwoofer 10. The close proximity of this electrically conductive heat shorting ring 92 to the magnetic air-gap and voice coil 102, not only helps improve heat dissipation, but reduces the distortion causing back electromotive force.

As delineated above, the lower ventilation apertures 30 of the frame 12, and the lower ventilation apertures 76 of the motor unit 82 are aligned to allow air to flow from the outside 14 of the subwoofer 10 into the first chamber area 106 inside 16 the subwoofer 10. The bottom vent aperture 36 of the frame 12 is also aligned with the center aperture 88 of the pole unit 82. This allows for air to be exchanged from the outside 14 of the subwoofer to the inside of the motor unit 68 and voice coil former 96. This vent arrangement allows a large volume of air flow to be constantly being exchanged due to the high excursion and volume of air underneath the dust cap 48 of the moving mass during use.

The large volume of air between the second spider 62 and the motor unit 68 is also constantly being exchange during use through the upper ventilation apertures 26 of the frame 12. The upper ventilation apertures 26 of the frame 12 allow air from outside 14 the subwoofer 10 into the second chamber area 108.

Optionally, porous mesh screen caps can be used to cover the various vent apertures of the frame 12, to prevent the intake of particulate matter into the subwoofer 10.

Additionally, the high energy magnet 91 has a center aperture 122 and ventilation channels 160 to allow air to flow through the magnet 91 from the voice coil former 96 (via the center of the former and through the vent apertures 104) to the inside of the voice coil chamber where the air is also circulated to the outside of the frame via the lower ventilation apertures 30 of the frame 12 and the lower ventilation apertures 76 of the motor unit 82.

The air gap provided in the motor unit 68 is assymetrical (best shown in FIG. 8). The upper gap width 110, between the top section 74 of the case 68 and the shorting ring 92, is different from the middle gap width 114, between the top section 74 of the case 68 and the field plate 90, which is different from the lower gap width 112, between the side section 74 of the case 68 and the cylindrical portion 86 of the pole unit 82. The upper gap width 110 is greater than that of the middle gap width 114. The magnetic gap height 200 is larger than the thickness 250 of the field plate 90. The field plate 90 is also suitably centered with respect to the top section 72 of the case 70. This magnetic air gap arrangement helps to focus fringe flux so as to minimize magnetic energy loss. The magnetic flux is thus spread out to affect more of the voice coil 102 in the gap. The motor 68 geometry and proportions of the subwoofer have been optimized through an iterative FEA (Finite Element Analysis) process.

At any one time, more area of the voice coil 102 is intimate to the motor case 68 steel than in any other design heretofore. This close proximity of steel to the voice coil 102 provides an ideal path for thermal transfer of heat away from the coil 102.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

The invention claimed is:

1. A subwoofer comprising:

a frame having an outside and an inside, a central portion, radial heat sink fins, lower ventilation apertures, and a bottom portion having a bottom vent aperture; and a motor unit comprising a case and a pole unit, the case having lower ventilation apertures and the pole unit having a cylindrical portion having a center aperture, a field plate, and a magnet; wherein the cylindrical portion of the pole unit is of a diameter less than the diameter of the case, defining a first chamber area; and wherein the lower ventilation apertures of the frame, and the lower ventilation apertures of the motor unit are aligned to allow air to flow from the outside of the subwoofer into the first chamber area.

2. The subwoofer of claim 1 further comprising:

a voice coil former having an upper and lower portion, and having vent apertures therethough; and a voice coil which is positioned on the lower portion of the voice coil former.

3. The subwoofer of claim 2, wherein the subwoofer further comprises:

a first spider having a first and second edge, the first edge being connected to the central portion of the frame, and the second edge being connected to the upper portion of the voice coil former.

4. The subwoofer of claim 3, wherein the subwoofer further comprises:

a second spider having a first and second edge, the first edge being connected to the central portion of the frame, and the second edge being connected to the upper portion of the voice coil former.

5. The subwoofer of claim 4 wherein the frame further comprises upper ventilation apertures, and wherein the second spider, frame and voice coil former define a second chamber area, wherein the upper ventilation apertures of the frame allow air to flow from the outside of the subwoofer into the second chamber area.

6. The subwoofer of claim 3 wherein the frame further comprises upper ventilation apertures, and wherein the first spider, frame and voice coil former define a second chamber area, wherein the upper ventilation apertures of the frame allow air to flow from the outside of the subwoofer into the second chamber area.

7. The subwoofer of claim 1, wherein the pole unit further comprises a shorting ring which is connected to the field plate of the pole unit.

8. The subwoofer of claim 7, wherein the shorting ring further comprises a plurality of ventilation grooves.

9. The subwoofer of claim 1 wherein the frame further comprises upper ventilation apertures.

10. The subwoofer of claim 1 wherein the magnet is segmented.

11. A subwoofer of comprising:

a frame having an outside and an inside, a central portion, radial heat sink fins, lower ventilation apertures, and a bottom portion having a bottom vent aperture; and a motor unit comprising a case and a pole unit, the case having a top section, a side section having lower ventilation apertures and a bottom lip section, and the pole unit having a base plate, a cylindrical portion having a center aperture, a field plate and a magnet; wherein the cylindrical portion of the pole unit is of a diameter less than the diameter of the side section of the case defining a first chamber area, defining a first chamber area; and wherein the lower ventilation apertures of the frame, and the lower ventilation apertures of the motor unit are aligned to allow air to flow from the outside of the subwoofer into the first chamber area.

12. The subwoofer of claim 11 further comprising:

a voice coil former having an upper and lower portion, and having vent apertures therethough; and a voice coil which is positioned on the lower portion of the voice coil former.

13. The subwoofer of claim 12, wherein the subwoofer further comprises:

a first spider having a first and second edge, the first edge being connected to the central portion of the frame, and the second edge being connected to the upper portion of the voice coil former.

14. The subwoofer of claim 13, wherein the subwoofer further comprises:

a second spider having a first and second edge, the first edge being connected to the central portion of the frame, and the second edge being connected to the upper portion of the voice coil former.

15. The subwoofer of claim 14 wherein the frame further comprises upper ventilation apertures, and wherein the second spider, frame and voice coil former define a second chamber area, wherein the upper ventilation apertures of the frame allow air to flow from the outside of the subwoofer into the second chamber area.

16. The subwoofer of claim 13 wherein the frame further comprises upper ventilation apertures, and wherein the first spider, frame and voice coil former define a second chamber area, wherein the upper ventilation apertures of the frame allow air to flow from the outside of the subwoofer into the second chamber area.

17. The subwoofer of claim 11 wherein the pole unit further comprises a shorting ring which is connected to the field plate of the pole unit.

18. The subwoofer of claim 17, wherein the shorting ring further comprises a plurality of ventilation grooves.

19. The subwoofer of claim 11 wherein the frame further comprises upper ventilation apertures.

20. The subwoofer of claim 11 wherein the magnet is segmented.

21. A subwoofer of comprising:

a frame having an outside and an inside, a central portion, a basket ring, a plurality of basket arms, radial heat sink fins, lower ventilation apertures, and a bottom portion having a bottom vent aperture;

a voice coil former having an upper and lower portion, and having vent apertures therethough;

a voice coil which is positioned on the lower portion of the voice coil former;

a cone having a first and second edge, the first edge being connected to a surround, which is connected to the basket ring of the frame, and the second edge being connected to the upper portion of the voice coil former;

a dust cap which is connected to the cone;

a first spider having a first and second edge, the first edge being connected to the central portion of the frame, and the second edge being connected to the upper portion of the voice coil former;

a motor unit comprising a case and a pole unit, the case having a top section, a side section having lower ventilation apertures and a bottom lip section, and the pole unit having a base plate, a cylindrical portion having a center aperture, and a magnet; wherein the cylindrical portion of the pole unit is of a diameter less than the diameter of the side section of the case defining a first chamber area; and wherein the lower ventilation apertures of the frame, and the lower ventilation apertures of the motor unit are aligned to allow air to flow from the outside of the subwoofer into the first chamber area.

22. The subwoofer of claim 21, wherein the subwoofer further comprises:

a second spider having a first and second edge, the first edge being connected to the central portion of the frame, and the second edge being connected to the upper portion of the voice coil former.

23. The subwoofer of claim 22 wherein the frame further comprises upper ventilation apertures, and wherein the second spider, frame and voice coil former define a second chamber area, wherein the upper ventilation apertures of the frame allow air to flow from the outside of the subwoofer into the second chamber area.

24. The subwoofer of claim 21, wherein the pole unit further comprises a shorting ring which is connected to the field plate of the pole unit.

25. The subwoofer of claim 24, wherein the shorting ring further comprises a plurality of ventilation grooves.

26. The subwoofer of claim 21 wherein the frame further comprises upper ventilation apertures.

27. The subwoofer of claim 21 wherein the frame further comprises upper ventilation apertures, and wherein the first spider, frame and voice coil former define a second chamber area, wherein the upper ventilation apertures of the frame allow air to flow from the outside of the subwoofer into the second chamber area.

28. A subwoofer comprising:

a frame having an outside and an inside, a central portion, radial heat sink fins, and a bottom portion having a bottom vent aperture; and a motor unit comprising a case and a pole unit, the case having a top section, a side section having lower ventilation apertures and a bottom lip section, and the pole unit having a base plate, a cylindrical portion having a center aperture, a field plate and a magnet; wherein the cylindrical portion of the pole unit is of a diameter less than the diameter of the side section of the case, and the diameter of the field plate is greater than the diameter of the magnet.

29. The subwoofer of claim 28, wherein the pole unit further comprises a shorting ring which is connected to the field plate of the pole unit.

30. The subwoofer of claim 29, wherein the shorting ring further comprises a plurality of ventilation grooves.

31. The subwoofer of claim 28 wherein the magnet is segmented.

32. The subwoofer of claim 28 wherein the filed plate is centered with respect to the top section of the case.

* * * * *